US005984119A

United States Patent [19]

Uhl

[11] Patent Number: 5,984,119

[45] Date of Patent: Nov. 16, 1999

[54] BACK SYSTEM FOR STORING AND TRANSPORTING CYLINDRICAL CONTAINERS

[76] Inventor: Kenneth T. Uhl, 1879 Mulberry, Yountville, Calif. 94599

[21] Appl. No.: 09/003,285

[22] Filed: Jan. 6, 1998

[51] Int. Cl.[6] ..... A47F 5/00

[52] U.S. Cl. ..... 211/59.4; 211/85.22; 410/49

[58] Field of Search ..... 211/85.5, 85.18, 211/85.22, 59.4, 13.1, 189, 194; 410/49; 108/52.1, 55.3, 56.1

[56] References Cited

U.S. PATENT DOCUMENTS

| | | | |
|---|---|---|---|
| 921,855 | 5/1909 | Loskamp | 211/85.22 |
| 1,938,126 | 12/1933 | Thompson | 211/85.22 |
| 3,019,916 | 2/1962 | Malcher | 108/55.3 X |
| 3,091,348 | 5/1963 | Neuhauser | 211/59.4 X |
| 3,476,260 | 11/1969 | Jay | 211/85.22 X |
| 3,606,023 | 9/1971 | Edmunds | 211/194 X |
| 4,190,165 | 2/1980 | Collins | 211/59.4 X |
| 4,506,796 | 3/1985 | Thompson | 211/59.4 |
| 5,060,810 | 10/1991 | Jones | 211/59.4 |

*Primary Examiner*—Robert W Gibson, Jr.

*Attorney, Agent, or Firm*—Spohn & Robertson LLP; Gerald L. Robertson

[57] ABSTRACT

Applicant's invention defines a barrel support rack made of non-metallic, non-corrosive material with rubberized cradles to keep barrels from shifting during movements such as stacking or transport. The support rack is modular in that a component useable as either the front or back of the rack is interlocked with a second component useable as either side to form a rack assembly. The side components protrude through opening in the front and back components, interlocking each thereto and are secured with a plurality of dowels. The simple doweled assembly allows rapid and economical take down and subsequent compact storage of said components when not in use. The ease of assembly and disassembly facilitates repair or replacement of damaged components. The non-metallic nature of the components allows the washing down or sterilization of the rack for beverage industry applications where a high degree of cleanliness is essential.

6 Claims, 6 Drawing Sheets

BACK SYSTEM FOR STORING AND TRANSPORTING CYLINDRICAL CONTAINERS

FIELD OF THE INVENTION

The present invention relates to a storage rack for cylindrical containers, such as drums, barrels, kegs or casks.

BACKGROUND OF THE INVENTION

At present, various rack designs are utilized to store and transport cylindrical containers. A traditional and very simple approach can be seen in U.S. Pat. No. 4,190,165 ("the Collins patent"), which discloses a method of stacking pipes utilizing chocks. The Collins patent discloses an improved chock "stick," but the overall chock concept is not new. Cylindrical objects such as pipes have been transported or stored with chocks, which are employed to keep the objects from rolling. This very simple method of retaining one or more cylindrical objects is useful in only certain applications where transport or storage is the primary objective. Similarly, U.S. Pat. No. 4,431,107 ("the Bergstrom et al. patent") is a modular rack array with limitations in that the rack may be used primarily for storage, but does not facilitate easy or convenient movement of the barrels. In the Bergstrom et al. patent, a base configuration used for the lowest tier of barrels is different from the supports for upper tiers. Many barrels may be stacked, one upon the other, but moving select barrels is not easy, particularly when the barrel to be moved is in the center of a large array of barrels.

Several patents disclose ways of handling several barrels without the limitations of the Bergstrom et al. patent. For example, U.S. Pat. No. 4,488,649 ("the Mark patent"), utilizes tubing in a configuration such that when reels are loaded onto the rack, another rack may fit on top of the first rack, resting on the reels themselves. In this way, the reels form part of the stacking system, and may be moved a few at a time. A limitation of the Mark patent is that in certain configurations, the racks may only be accessed by a fork lift from a single direction, the front.

The Mark patent also discloses a tubular system which can be disassembled and reassembled in differing sizes. While it is attractive to be able to store unused racks in a disassembled state, because the racks in the Mark patent are held together by traditional hardware like nuts and bolts, the racks demand significant time and labor in their disassembly and reassembly.

U.S. Pat. No. 3,019,916 ("the Malcher patent") discloses a rack which also facilitates the stacking of drums utilizing a fork lift. Such a rack is an improvement over the Collins patent, the Bergstrom et al. patent, and the Mark patent in that Malcher allows stacking to be accomplished from the front or the side of the rack. In this method, a few barrels may be moved at a time from a variety of directions. Malcher also teaches a rack which is assembled with traditional hardware, and can be broken down for storage.

U.S. Pat. No. 4,506,796 ("the Thompson patent"), discloses another rack structure allowing access by a forklift on four sides. The "V" configuration of the Thompson patent allows a variety of sizes of barrels to be stored, an improvement over the Malcher patent's round "cradle." However, the Thompson patent also teaches an assembled rack which requires significant labor to prepare the rack for storage.

A rack which is widely used in the wine industry is the subject of U.S. Pat. No. 3,476,260 ("The Jay patent"). The Jay patent is a welded metal rack which provides very good strength, necessary for stacking wine barrels. Because it is welded, the rack disclosed in the Jay patent does not break down for easy storage.

All of the previously mentioned patents except Collins (not really a rack) teach the use of metal for the rack material. While stronger than wood, a disadvantage which comes from using metal for a wine barrel rack is the leakage of liquid attendant to wine making. For example, when new barrels are used, and in the case of premium wines, often, new barrels for each vintage are employed, the barrels absorb enough wine that "topping off" the barrels is done often, which means spillage. Also, often times wine makers will move wine from barrel to barrel in the fining process. As a result, wine is sometimes spilled during its transfer. Because of all the operations attendant to the making of wine, and resulting in spillage of wine, yeast or chemicals, from time to time barrel racks must be sterilized. This is typically accomplished by steam cleaning. Because metal is easier to clean than wood, metal racks are superior to wood in terms of preventing bacterial growth. However, metal racks rust, requiring maintenance in the form of sandblasting or painting. Such efforts are expensive, not just in the actual maintenance itself, but also in the consequential unstacking and restacking of barrels required to free up racks needing attention.

In the wine business in particular, it is desirable to leave a barrel of fermenting or aging wine undisturbed. Consequently, this means that the need for servicing barrel racks should be minimized to prevent disturbing the wine. This also means that a barrel rack should preferably be accessible on all sides by a forklift to minimize the moves required in handling the barrels, and the potential for dropping a barrel.

Because of the need to service barrel racks, a preferred design would accommodate the rapid assembly and disassembly of the rack to prevent floor space from being used up by empty barrel racks.

Further, because of the need for servicing, a preferred barrel rack would employ a material of high strength, but resistant to corrosion, and which could be easily chemically treated or sterilized.

What is needed is a rack which allows stacking of various sized barrels, accessible by a forklift from all four sides, which may be stored without great time or labor, using minimal floor space, and which is resistant to corrosion thereby needing little maintenance. Such a rack should also provide secure retention of the barrels or containers which are to be stored.

SUMMARY OF THE INVENTION

Broadly stated, the present invention encompasses a non-metallic barrel rack made of two components which are each usable as either the front or back side, or the left or right side. These components interlock with one another with a simple dowel arrangement, allowing rapid assembly or disassembly. The rack has provisions for forks from either side, and by its non-metallic nature, is resistant to corrosion and is easily cleaned.

The preferred embodiment employs a rubberized bearing surface to prevent slippage of barrels during stacking or movement.

DETAILED DESCRIPTION OF THE INVENTION

Figure 1:
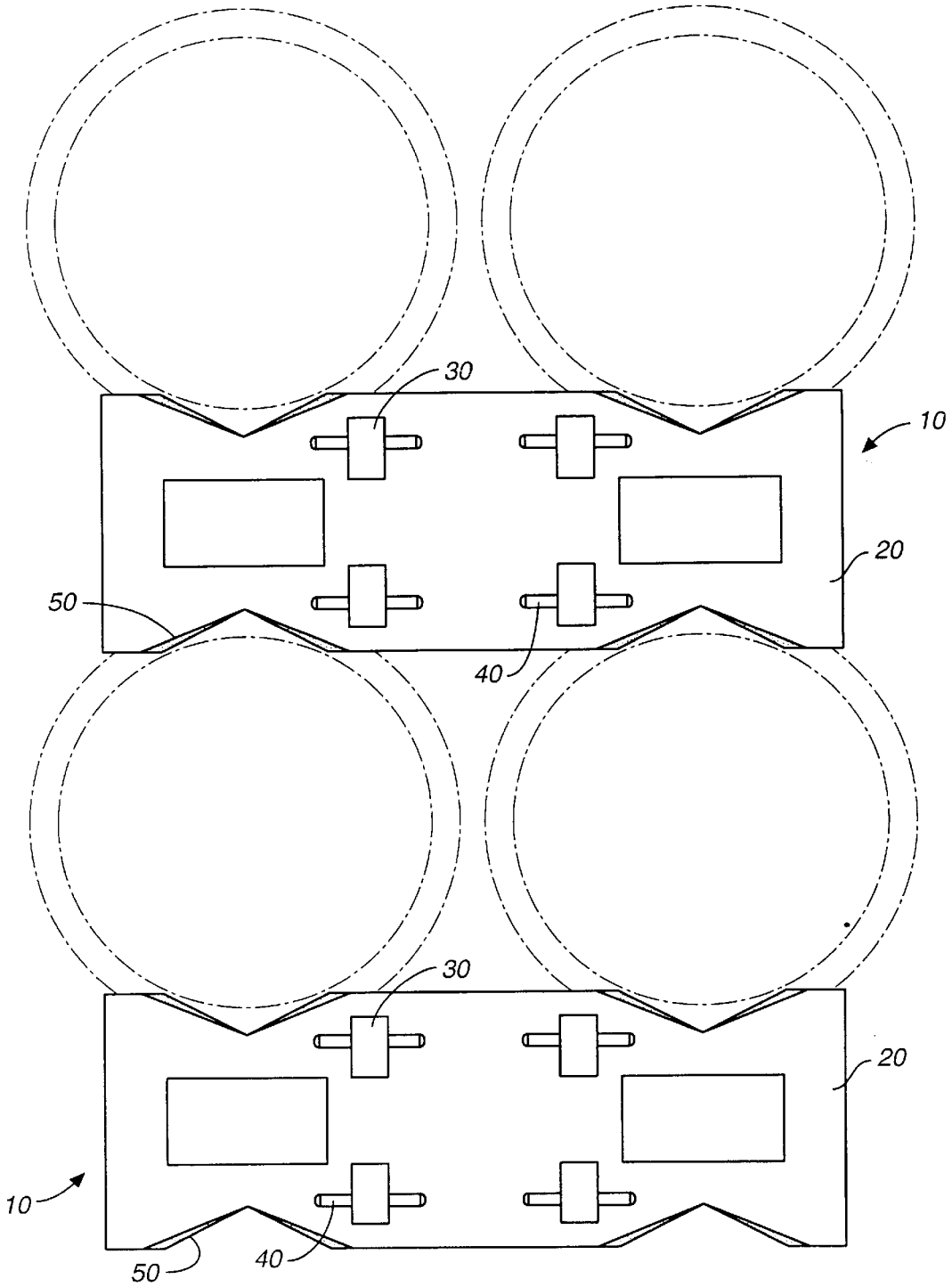
FIG. 1 is a frontal elevational view of two of Applicant's barrel racks stacked vertically and showing the front/rear cradle frame.

In a preferred embodiment in FIG. 1, two barrel rack assemblies 10 are shown stacked as they would be used to hold four barrels. A generally rectangular cradle frame 20 is assembled to a pair of side frames 30 using a plurality of dowels 40. Cradle frame 20 can be used as a frontal or rear piece in the assembly just as side frame 30 can be used on either side of assembly 1 0. As shown, cradle frame 20 is provided with a plurality of "V"-shaped cradles 50 at a predetermined distance from one another along its upper and lower edges. The "V" shape allows barrels of different sizes to be supported, the only limiting factor being the distance between the cradles.

Figure 2:
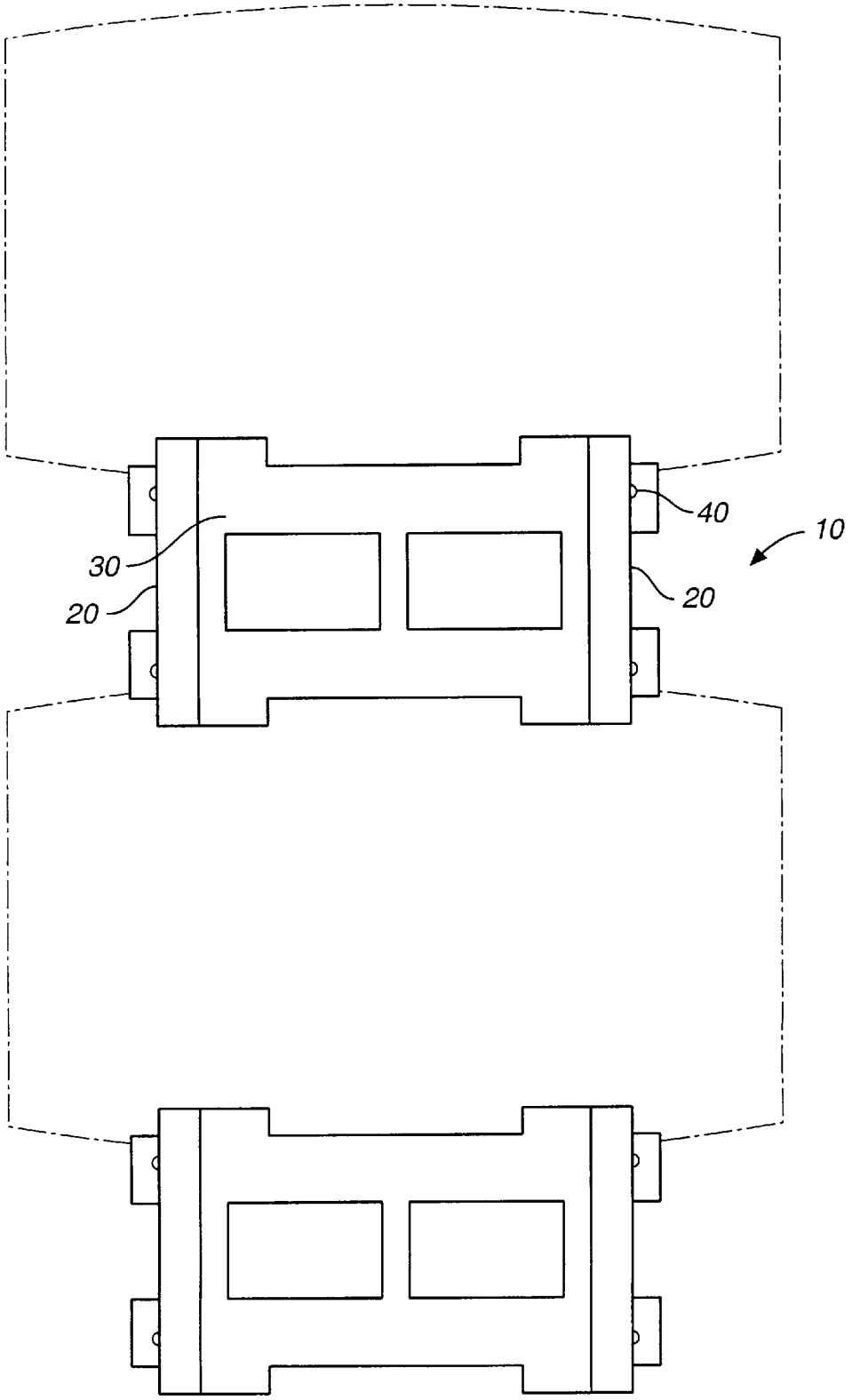
FIG. 2 is a side elevational view of FIG. 1 showing the differences between the side frame and the cradle frame disclosed in FIG. 1.
Figure 3A:
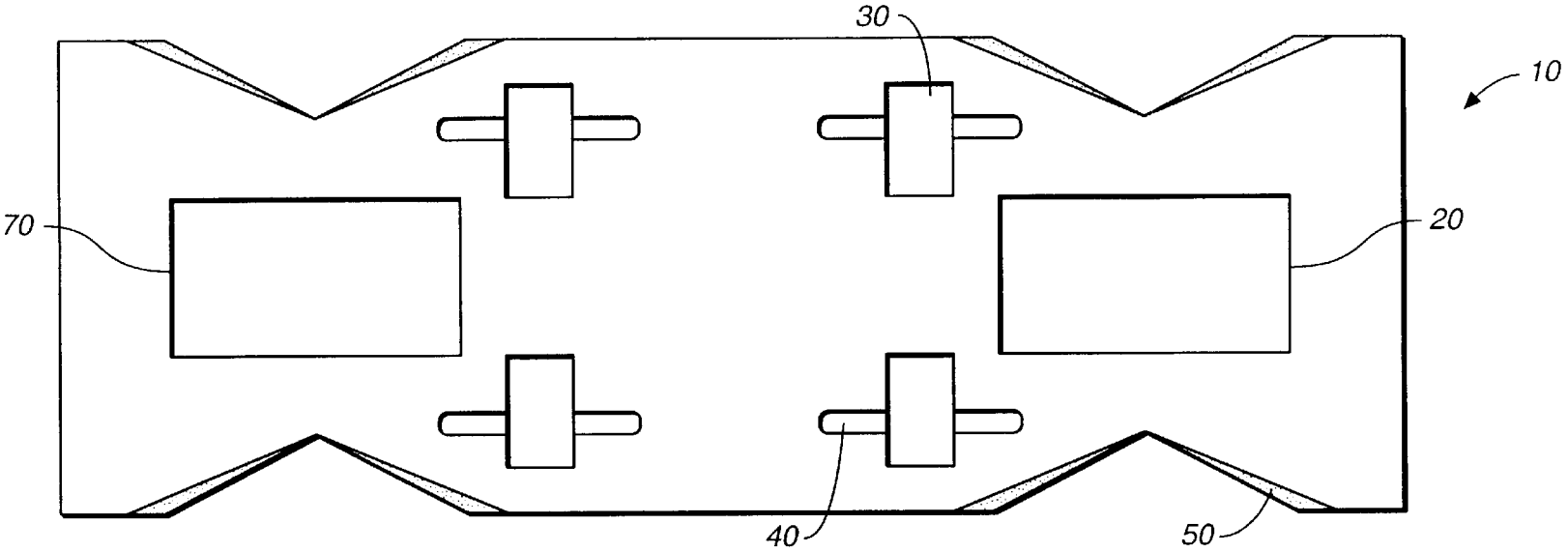
FIG. 3A is a front elevational view of the barrel rack showing the "V"-shaped cradle and is non-skid lining.
Figure 3B:
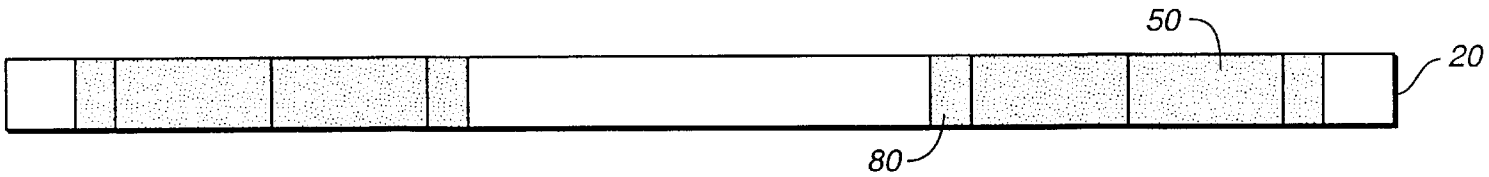
FIG. 3B is a top plan view of the front/rear cradle frame.

FIG. 2 shows the side of barrel rack 10, more filly disclosing side frame 30. A plurality of ears 60 are used to protrude through cradle frame 20, and which are then secured by dowels 40. FIG. 3A shows the cradle frame and two windows 70, which are provided to accept the forks of a forklift which can then lift and move the racks. Ears 60 are shown protruding through cradle frame 20, and pinned by dowels 40. Further, a non-skid liner 80, best shown in FIG. 3B is installed onto "V"-shaped cradle 50. Liner 80 is retained on cradle 50 by a number of means such as pinning, gluing, molding or other attachment means.

Frame components 20 and 30 may be constructed of an engineered plastic such as LEXAN® or a graphite or carbon fiber composite or other non-metallic material of similar strength and capable of injection or other molding. Polymers of various kinds may be used as long as they can withstand the forces exerted on them by barrels of liquid. A barrel of liquid can weigh up to 650 pounds, so a stack of barrels 6 high would have roughly 8000 pounds force on the lowest barrel rack. That is roughly 2000 pounds at each of four loading points, said points approximating 4 square inches each. Thus the design must withstand approximately 500 pounds per square inch. A variety of materials are available which can withstand such force.

Figure 4A:
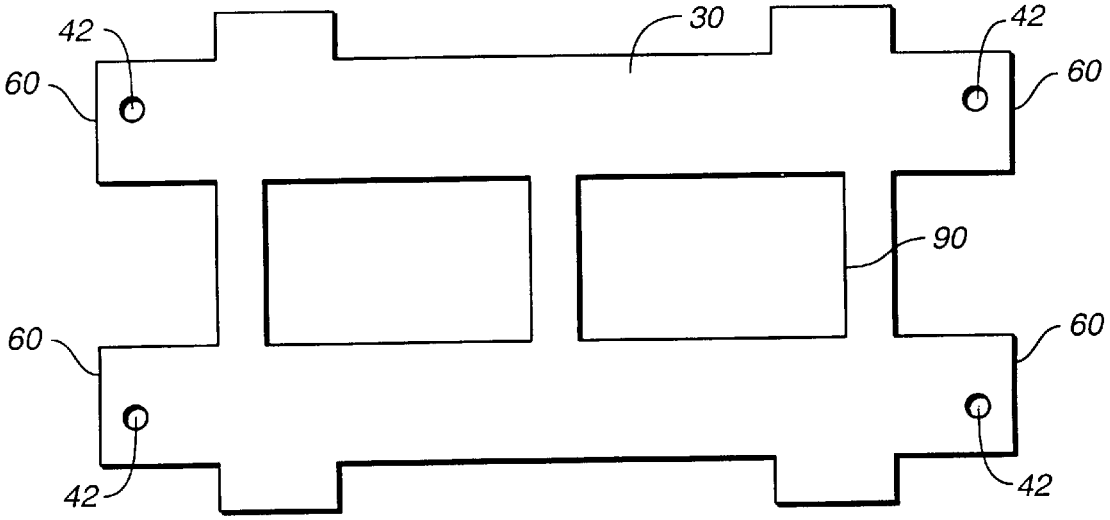
FIG. 4A is a side elevational view of the side frame component which may be used as either the front or back of the barrel rack assembly.
Figure 4B:
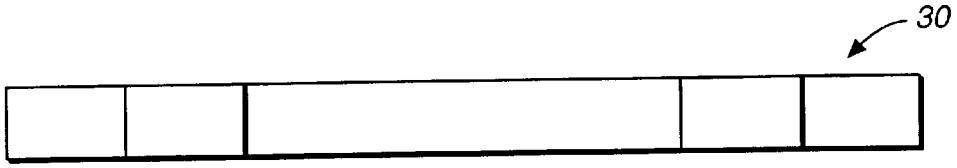
Figure 5A:
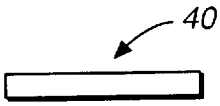
FIG. 5A is a front elevational view of the dowel used to assemble the side frames to the cradle frames.
Figure 5B:
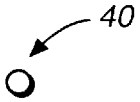
FIG. 5B is a side elevational view for the dowel in FIG. 5A.
Figure 6:
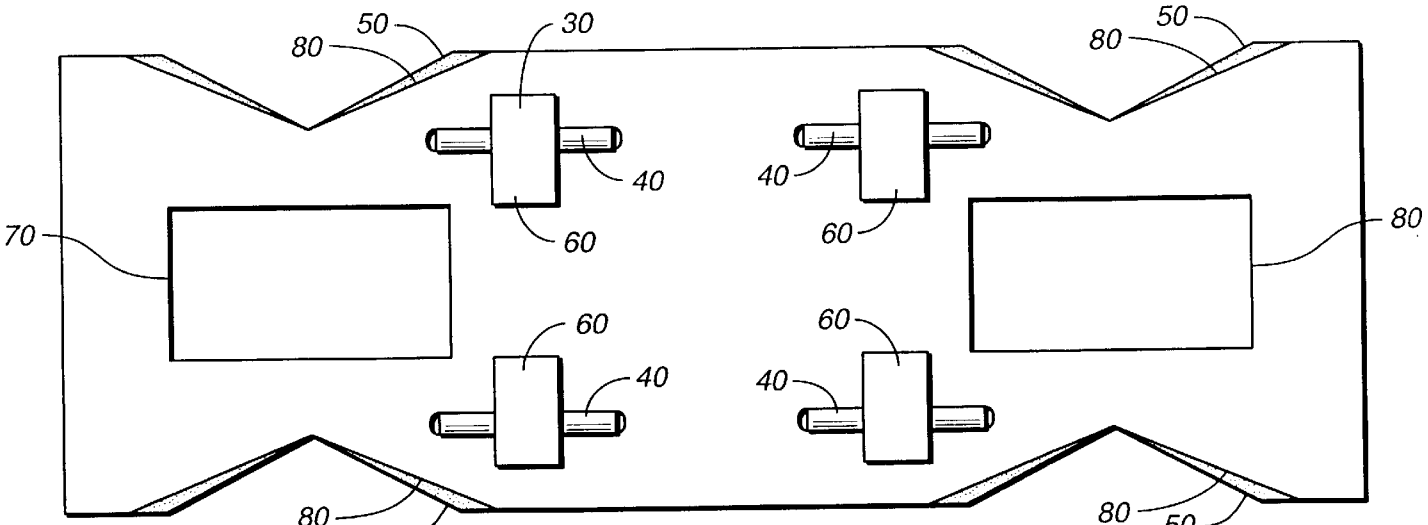
FIG. 6 is a front elevational view of the assembled barrel rack.
Figure 7:
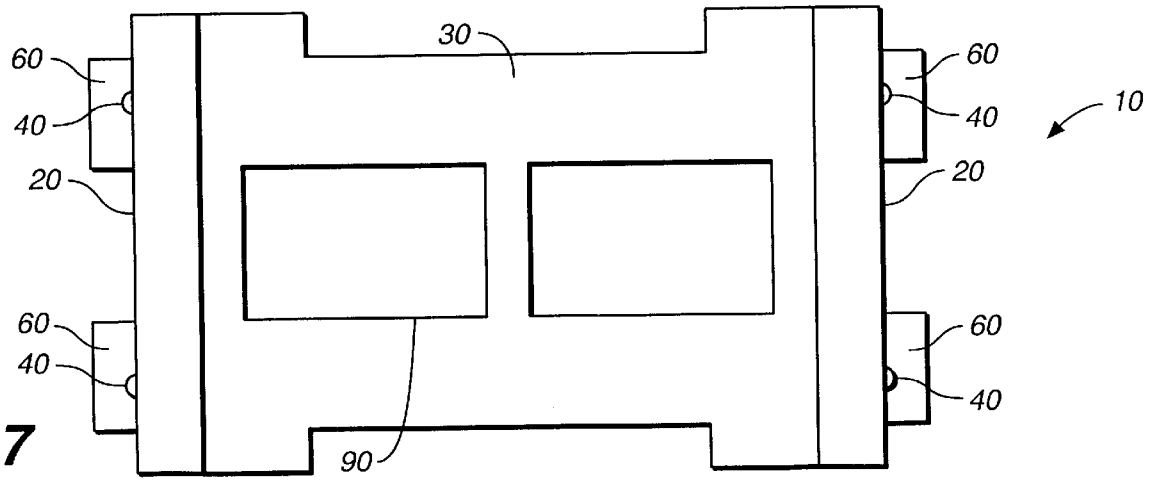
FIG. 7 is a side elevational view of the barrel rack of FIG. 6.

FIG. 4 shows side frame 30, which is provided with holes 42 to accept dowels 40, shown in FIGS. 5A and 5B. Two windows 90 are also provided in side frame 30 to accept the forks of a forklift, thereby allowing the barrel rack assembly 10 to be manipulated from all sides. FIGS. 6 and 7 disclose barrel rack assembly 10 showing all structure except the openings in the cradle frame which ears 60 of side frame 30 protrude through. These accesses are sized very close to the size of the ears, so that assembly will be firm. Dowels 40 may be of a resilient material which could be swedged into similarly shaped depressions in the cradle frame (not shown) which would serve to allow rapid knock down and assembly. Other retention means for the dowels might be snap rings, notched dowels, etc. A variety of retaining means are known in similar arts which could be applied here.

Figure 8:
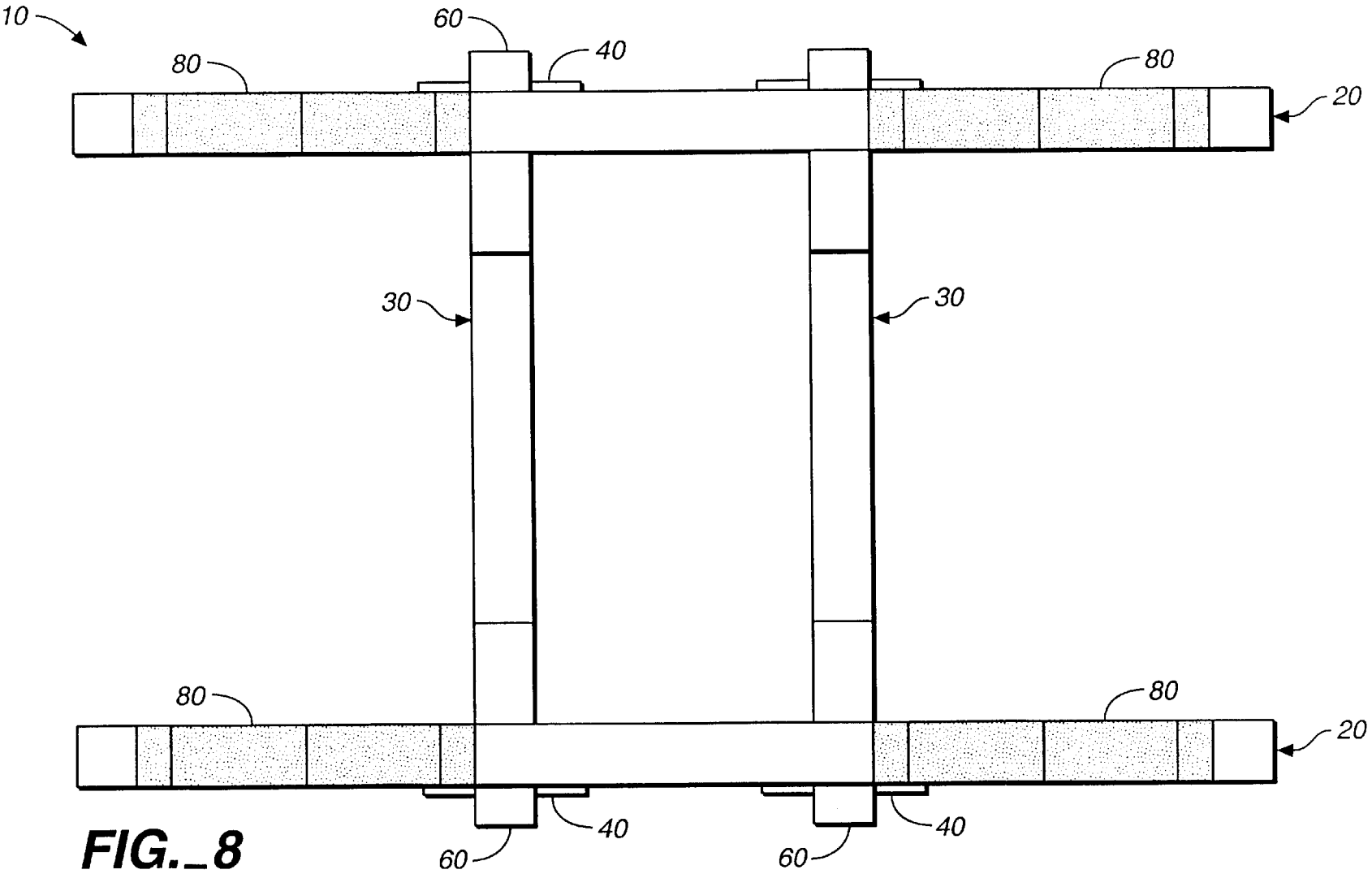
FIG. 8 is a top plan view of the preferred embodiment of Applicant's barrel rack.

The plan view of barrel rack 10 in FIG. 8 discloses the relative proportions of the frame components and also shows a typical location of the side frames located inside the cradles with liners 80.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. A rack for supporting and handling cylindrical objects comprising:

non-metallic interlocking frame components, said frame components forming windows for accepting a fork-truck's forks; and cradles positioned a predetermined distance from one another on the top and bottom edge of said frame components.

2. The rack as described in claim 1, further comprising:

non-skid linings fastened to said cradles.

3. A rack for supporting and handling cylindrical objects comprising:

a cradle frame of non-metallic material, said cradle frame having a plurality of "V"-shaped cradles at a predetermined distance along its top and bottom edges, said cradle frame forming two windows located and shaped to safely accept the forks of a forklift for lifting;

a side frame of non-metallic material said side frame having a plurality of windows located and shaped to safely accept the forks of a forklift for lifting; and means for interlocking a plurality of side frames and cradle frames together.

4. The rack described in claim 3 further comprising:

non-skid linings fastened to said cradles.

5. The rack described in claim 3 wherein:

said means for interlocking comprising ears having holes therein formed on the ends of said side frames;

accesses formed in said cradle frames and sized to accept said ears therethrough; and a plurality of dowels sized to fit through said holes.

6. The rack described in claim 5 wherein:

said cradle frames are provided with depressions on either side of said accesses for retaining said dowels.

* * * * *